United States Patent [19]

Boschung

[11] 4,388,018

[45] Jun. 14, 1983

[54] ECCENTRIC-DISK TAMPER

[75] Inventor: Marcel Boschung, Schmitten, Switzerland

[73] Assignee: Boschung Holding A.G. Freiburg, Fribourg, Switzerland

[21] Appl. No.: 252,853

[22] Filed: Apr. 10, 1981

[30] Foreign Application Priority Data

Mar. 6, 1981 [CH] Switzerland ..... 1563/81

[51] Int. Cl.[3] ..... E01C 19/38

[52] U.S. Cl. ..... 404/113; 404/133

[58] Field of Search ..... 404/113, 133, 116

[56] References Cited

U.S. PATENT DOCUMENTS

| | | | |
|---|---|---|---|
| 2,687,071 | 8/1954 | Day | 404/113 |
| 2,737,094 | 3/1956 | Jackson | 404/113 |
| 2,938,438 | 5/1960 | Hamilton | 404/113 |
| 2,951,427 | 9/1960 | Moir | 404/133 |
| 3,181,442 | 5/1965 | Brigel | 404/113 |
| 3,232,188 | 2/1966 | Frohnauer | 404/113 |
| 3,240,134 | 3/1966 | McRae | 404/133 |
| 3,327,598 | 6/1967 | Wayer | 404/133 X |
| 3,635,133 | 1/1972 | Stougaard | 404/133 |
| 3,930,741 | 1/1976 | Berry | 404/133 |

FOREIGN PATENT DOCUMENTS 382210 11/1964 Switzerland .

*Primary Examiner*—Nile C. Byers, Jr.

*Attorney, Agent, or Firm*—Dann, Dorfman, Herrell and Skillman

[57] ABSTRACT

An eccentric-disk tamper, comprising a vibrator frame intended to be raisably and lowerably attached to a vehicle, also comprises at least one vibrator unit connected to the frame by means of parallel guide linkages and bolts disposed at the pivot points. To avoid wear and tear on the joint bolts and to maintain the damping effect of a rubber insert, the bolts are non-rotatably secured to an inner metal sleeve of a coupling link which further includes an outer metal sleeve and, compressed between these two sleeves, a rubber cylinder non-rotatably fixed to both sleeves. Each such coupling link is non-rotatably connected to a respective guide rod of a parallel linkage. A stop disposed between two such guide rods limits their angle of displacement to displacement within the elastic limit of the rubber.

5 Claims, 2 Drawing Figures

FIG. 1
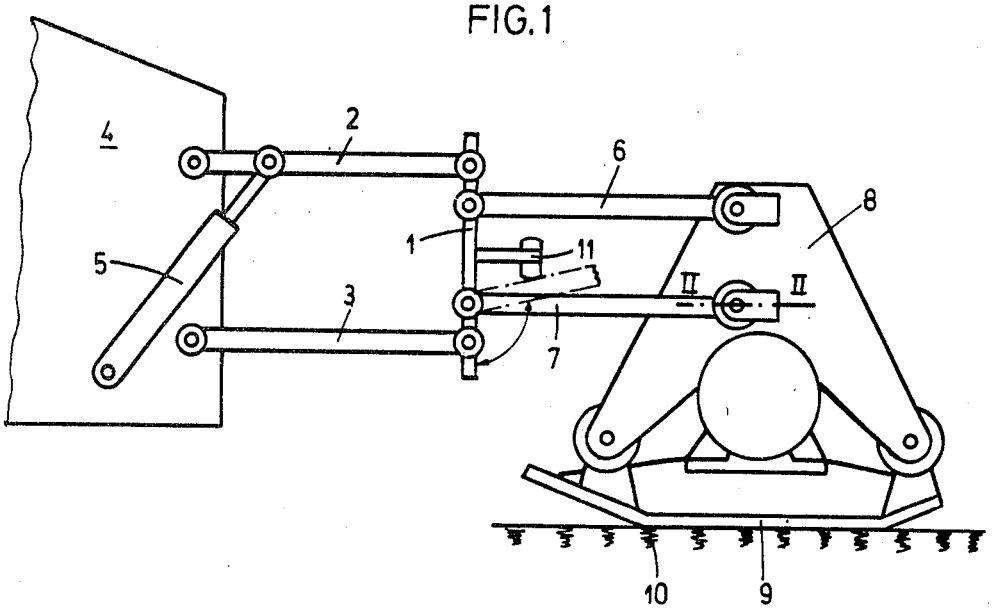
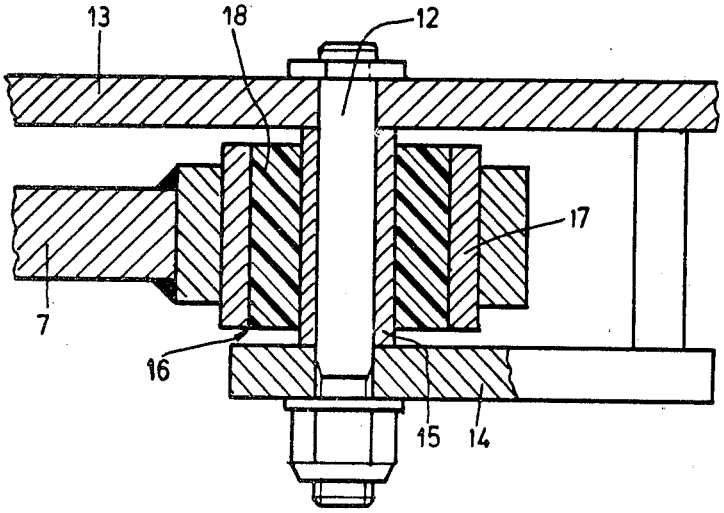
FIG. 2

ECCENTRIC-DISK TAMPER

This invention relates tamping and compacting equipment, particularly to an eccentric-disk tamper of the type having a vibrator frame intended to be raisably and lowerably disposed on a vehicle, and at least one vibrator unit connected to the vibrator frame by means of parallel guide linkages and bolts disposed at the pivot points thereof.

Eccentric-disk tampers suitable and intended to be connected to a vehicle generally have a vibrator frame to which the vibrator units are coupled and which is connected to the vehicle, or to a holding device secured to the vehicle, by means of a parallel guide linkage, usually hydraulically operated. The parallel guide linkage is used for lowering and raising the vibrator frame, which is in turn connected via further parallel guide linkages to one or more vibrator units. These last-mentioned parallel guide linkages are used for setting the vibrator unit or units on the ground surface to be treated; and the guide rods, each articulated at one end to a vibrator unit, carry out oscillating movements corresponding to the vibrators of the respective vibrator unit. These oscillating movements, which lead to reciprocating pivotal movements in the points of articulation of the guide rods both at the vibrator unit and at the fixed vibrator frame, are then transmitted as annoying vibrations via the vibrator frame to the vehicle.

It has already been proposed (cf. FIG. 2 of Swiss Pat. No. 382,210, for example) to damp these vibrations by inserting rubber buffers between the mutually pivotable parts in the points of articulation of the guide rods at the vibrator unit. However, a decisive drawback of this kind of damping is that after a certain angle of displacement between a guide rod and the vibrator unit has been exceeded, the rubber insert becomes permanently deformed, thus substantially impairing the damping effect.

It is an object of this invention to provide an improved eccentric-disk tamper having damping means of the aforementioned kind in which excessive or permanent deformation of the rubber buffers can no longer occur.

To this end, in the eccentric-disk tamper according to the present invention, of the type initially mentioned, the bolts, secured against relative rotation, are connected to an inner metal sleeve connected to a guide rod and of a coupling link which further comprises an outer metal sleeve, also secured against angular displacement relative thereto, and between which sleeves a resilient cylinder is pressed in so that opposite inner and outer surfaces are secure against angular displacement relative to the inner and the outer sleeve respectively is pressed in, at least one stop intervening between the two guide rods of a parallel linkage being provided.

A preferred embodiment of the invention will now be described in detail with reference to the accompanying drawing, in which:

FIG. 1 is a diagrammatic elevation showing the suspension from a vehicle of a vibrator unit set upon the ground, and FIG. 2 is a section taken on the line II—II of FIG. 1, on a much larger scale.

As may be seen in FIG. 1, a vibrator frame 1 is connected by means of a pair of guide rods 2 and 3 to a part of a vehicle and can be raised and lowered by means of a hydraulic unit 5. Linked in turn to frame 1 via another pair of guide rods 6 and 7 is a vibrator unit 8, a vibrator plate 9 of which rests on the ground 10. Between the points of articulation of guide rods 6 and 7, a stop 11 is connected to the frame 1, by means of which the guide rods 6 and 7 are prevented from pivoting through more than a certain angle relative to frame 1 and vibrator unit 8, as indicated by broken lines in FIG. 1.

The structure of the joints linking guide rods 6 and 7 to vibrator unit 8 is shown in FIG. 2, where a joint of guide rod 7 is depicted on a much larger scale. All the joints of all the guide rods may be designed in the same way, in the linkage to vibrator frame 1 as well as to vibrator unit 8. It will be seen from FIG. 2 that bolts 12 non-rotatably pass through a sheet-metal casing 13 and a flange 14, between which parts the swivel end of guide rod 7 is inserted. Each bolt 12, in turn, is non-rotatably secured to an inner metal sleeve 15 of a coupling link 16, while an outer metal sleeve 17 of larger diameter is secured to guide rod 7 in the same way. Inserted between sleeves 15 and 17 is a resilient cylinder 18, preferably a rubber cylinder, so compressed that even if sleeves 15 and 17 are twisted relative to one another, no relative rotation between either of these sleeves and the respective confronting surface of the rubber cylinder 18 takes place. Now such relative angular displacement between sleeves 15 and 17 does occur whenever there is a swivelling movement, e.g., of guide rod 7 about the bolt 12 associated therewith, namely, during every raising or lowering operation. However, instead of there being a friction-producing movement between two components of the joint, necessarily leading to wear and tear, the mutual twisting of metal sleeves 15 and 17 causes nothing more than internal deformation of rubber cylinder 18. What is decisive is that this deformation is within the elastic limit of the rubber cylinder, so that it is not permanent, and that by means of this deformation, reciprocal rubbing together of parts involved in the swivel movement is precluded, so that there is no friction with resultant wear and tear.

Furthermore, because of stop 11, a guide rod 6 or 7 can pivot only through a certain angle relative to the corresponding part of vibrator frame 1, this angle being determined by the position and size of stop 11. Because of this limitation of the angle of displacement of a guide rod through appropriate selection of the arrangement and dimensions of stop 11, deformation of rubber cylinder 18 can reach only such an extent that no permanent deformation occurs, and the rubber buffer in the form of rubber cylinder 18 can consequently retain its damping effect.

What is claimed is:

1. An eccentric-disk tamper of the type having a vibrator frame intended to be raisably and lowerably disposed on a vehicle, at least one vibrator unit, and at least one parallel linkage connecting said unit to said frame, each said parallel linkage including a plurality of guide rods pivoted to support members of said frame and said unit, a plurality of coupling links disposed at respective pivot points of said linkage, and a plurality of bolts forming part of said coupling links, wherein the improvement comprises:

a first metal sleeve surrounding and non-rotatably secured to each of said bolts in each of said coupling links, a resilient cylinder for each link having one surface surrounding and non-rotatably secured to said first metal sleeve, a second metal sleeve for each link surrounding and non-rotatably secured to the opposite surface of said resilient cylinder, the resilient characteristic of said cylinder affording resilient relative rotation between said opposite surfaces about the cylinder axis, one of said support members being non-rotatably connected to said first metal sleeve and one of said guide rods non-rotatably connected to said second metal sleeve, and at least one stop means disposed between said support member and said guide rod to limit the angular displacement of said guide rod relative to said support member.

2. A tamper according to claim 1 wherein said resilient cylinder has an elastic limit within which permanent deformation cannot occur, and said stop means limits said displacement angle to within the elastic limit of said cylinder.

3. A tamper according to claim 2 wherein said support member extends between and is common to adjacent coupling links of said parallel linkage, and the guide rods of said adjacent coupling links are parallel to one another, said stop means being mounted on said support member between said links and engagable alternatively with the guide rods of said coupling links to limit respectively clockwise and counterclockwise angular displacement to within said elastic limit.

4. A tamper according to claim 1 wherein said cylinder is a hollow rubber cylinder having an elastic limit greater than the deformation produced by the angular displacement limited by said stop means.

5. An eccentric-disk tamper of the type having a vibrator frame intended to be raisably and lowerably disposed on a vehicle, at least one vibrator unit, and at least one parallel linkage connecting said unit to said frame, each said parallel linkage including a plurality of guide rods pivoted to support members of said frame and said unit, a plurality of coupling links disposed at respective pivot points of said linkage, and a plurality of bolts defining the pivotal axes of said coupling links, wherein each coupling link comprises:

a first member non-rotatably secured to each of said bolts in each of said coupling links, a resilient cylinder having an axis coaxial with said pivotal axis of said coupling link and having one surface non-rotatably secured to said first member, a second member non-rotatably secured to the opposite surface of said resilient cylinder, the cylinder being elastic so that the resilient characteristic of said cylinder affording relative rotation about the cylinder axis between said opposite surfaces to thereby afford relative pivotal movement on said axis between said first and second members, and at least one stop means disposed between said first and second members to limit the angular displacement of said members to within the elastic limit of said resilient cylinder.

* * * * *